US005090892A

United States Patent [19]

Chuang

[11] Patent Number: 5,090,892

[45] Date of Patent: Feb. 25, 1992

[54] GAS LIGHTER WITH ROTATIONAL BINGO MEANS

[76] Inventor: Jack Chuang, c/o Hung Hsing Patent Service Center, P.O. Box 55-1670, Taipei (10477), Taiwan

[21] Appl. No.: 680,324

[22] Filed: Apr. 4, 1991

[51] Int. Cl.[5] ..... F23Q 3/00

[52] U.S. Cl. ..... 431/125; 431/253

[58] Field of Search ..... 431/253, 125, 126, 344, 431/277, 255; 273/142 R, 141 R, 141 A, 138 R, 138 A, 139; 446/175, 236, 242, 484

[56] References Cited

U.S. PATENT DOCUMENTS 1,039,553 9/1912 Ashbaugh et al. ..... 431/126 X
3,001,307 9/1961 Siene ..... 431/126
3,011,781 12/1961 Avery et al. ..... 431/125 X
4,522,583 6/1985 Kraser ..... 431/125
4,946,383 8/1990 Wu ..... 431/125
4,948,361 8/1990 Wu ..... 431/125

*Primary Examiner*—Larry Jones

[57] ABSTRACT

A gas lighter includes a rotating disk rotatably mounted in a lighter casing and operatively rotated upon a depression of a push button for igniting a flame from the lighter to mimic a roulette, and a lotto flash driver simultaneously operatively flashing, upon the depression of the push button, a plurality of indicator lamps such as light emitting diodes annularly provided on a base plate secured in the casing under the rotating disk in a circular flashing direction opposite to a rotating direction of the rotating disk for enriching a visual entertaining effect as well as an audio sounding when a buzzer is provided with the lotto flash driver.

5 Claims, 4 Drawing Sheets

GAS LIGHTER WITH ROTATIONAL BINGO MEANS

BACKGROUND OF THE INVENTION

A conventional gas lighter is provided for producing a naked flame to light cigarettes and so on. In order to enrich further uses of a gas lighter, a sounding device may be provided in the lighter to produce single short sound when igniting a flame for entertaining the lighter user. The lighter may also be mounted on a pen barrel or pen cap for both writing and lighting purposes.

However, a table lighter placed on a table surface is heavier and larger than a portable lighter so that a table lighter even provided with electronic visual or audio device is not suitable to be potably carried for audible or visual entertaining purposes.

It is therefore expected to disclose a gas lighter, especially a table lighter, which can be ignited for producing flame and also for producing visual display and audio sound for entertaining and playing purposes.

SUMMARY OF THE INVENTION

The object of the present invention is to provide a gas lighter including a rotating disk rotatably mounted in a lighter casing and operatively rotated upon a depression of a push button for igniting a flame from the lighter to mimic a roulette, and a lotto flash driver simultaneously operatively flashing, upon the depression of the push button, a plurality of indicator lamps such as light emitting diodes annularly provided on a base plate secured in the casing under the rotating disk in a circular flashing direction opposite to a rotating direction of the rotating disk for enriching a visual entertaining effect as well as an audio sounding when a buzzer is provided with the lotto flash driver.

DETAILED DESCRIPTION

Figure 1:
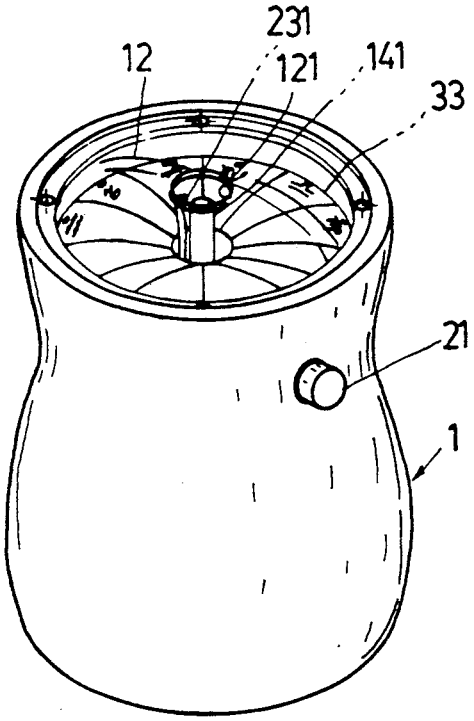
FIG. 1 is a perspective view of the present invention.

As shown in FIGS. 1–6, the present invention comprises: a lighter means 1, an actuating means 2, a rotating disk means 3, and an electronic driving means 4.

The lighter means 1 includes: a lighter casing 11, a gas container 13 formed in a lower portion of the casing 11 below a middle partition plate 10 filled with butane gas or the like, an upper chamber 17 formed on an upper portion of the casing 11 above the partition plate 10, a top cover 12 made of transparent material having a central opening 121 for projecting a flame burned from a burner 141 formed on a top tip portion of a gas tube 14 vertically formed in the gas container 13 as controlled by a gas valve 15, and an upper flange 16 formed in the upper chamber 17 inside the casing 11. The lighter means 1 may be made as a table lighter having the casing 11 made of electrically insulative materials.

The actuating means 2 includes: a push button 21 reciprocatively formed in the casing 11, an actuating rod 22 coupled with the push button 21 and reciprocatively held in a sparking generator 23, the sparking generator 23 capable of producing high tension spark at a sparking terminal 231 protruding upwardly towards the central opening of the top cover 12, and a trigger lever 24 for opening the gas valve 15 and for actuating a trigger switch 44 of the electronic driving means 4. The actuating rod 22 is secured with s spring bar 221 retained between two limiting stoppers 222.

Figure 5:
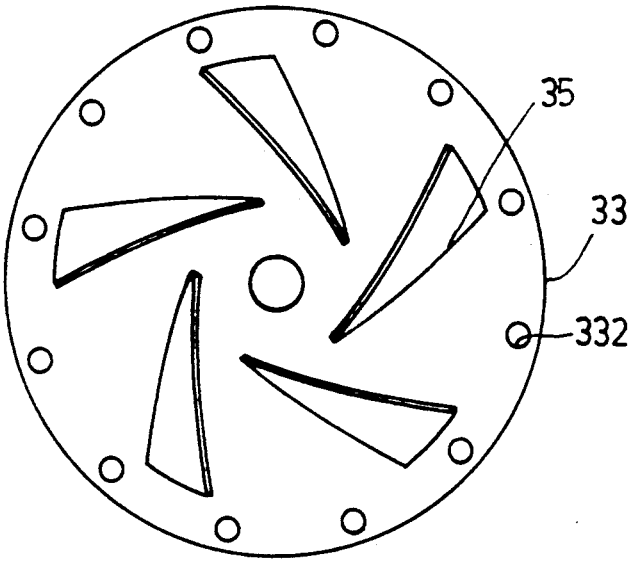
FIG. 5 is a bottom view of the rotating disk of the present invention.
Figure 4:
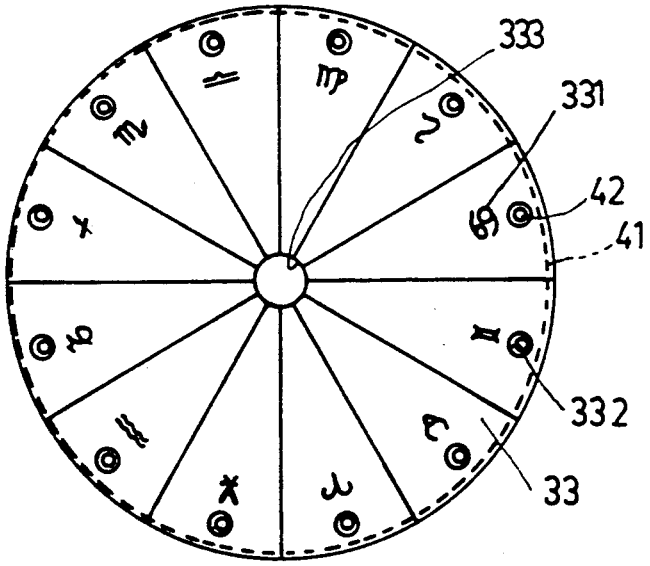
FIG. 4 is a top view of the rotating disk of the present invention.

The rotating disk means 3 includes: a driving gear 31 having a plurality of main ratchet teeth 311 engageable with the spring bar 221, a hollow shaft 32 secured with the driving gear 31 protruding upwardly to be rotatably mounted in a base plate 41 of the electronic driving means 4, a rotating disk 33 secured on an upper end portion of the hollow shaft 32 having a plurality of decorative features 331 annularly distributed on a periphery of the disk 33, a plurality of upper ratchet teeth 34 annularly formed on a central bottom portion of the disk 33, and a plurality of propeller impellers 35 generally radially formed on a bottom portion of the disk 33 as shown in FIG. 5.

Figure 2:
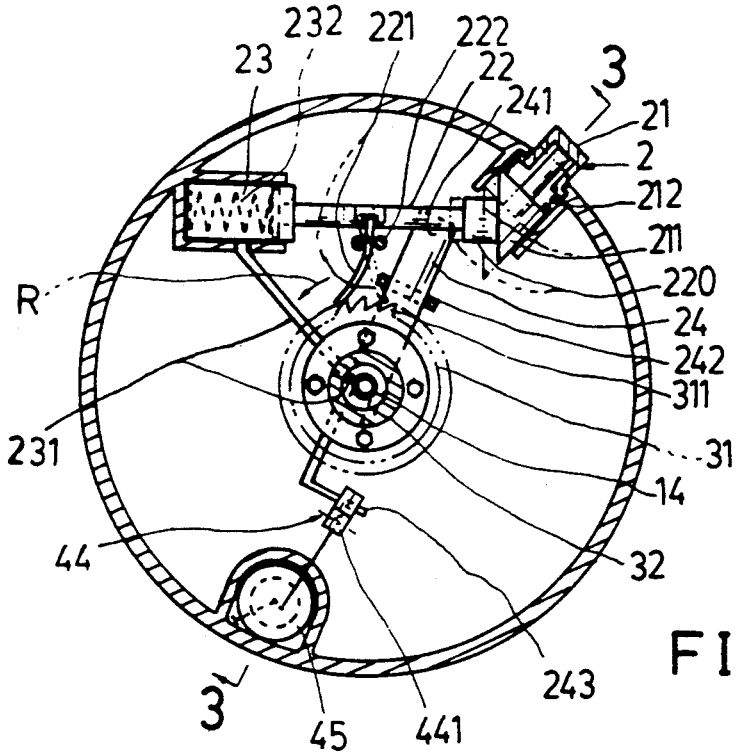
FIG. 2 is a cross sectional drawing of the present invention.
Figure 3:
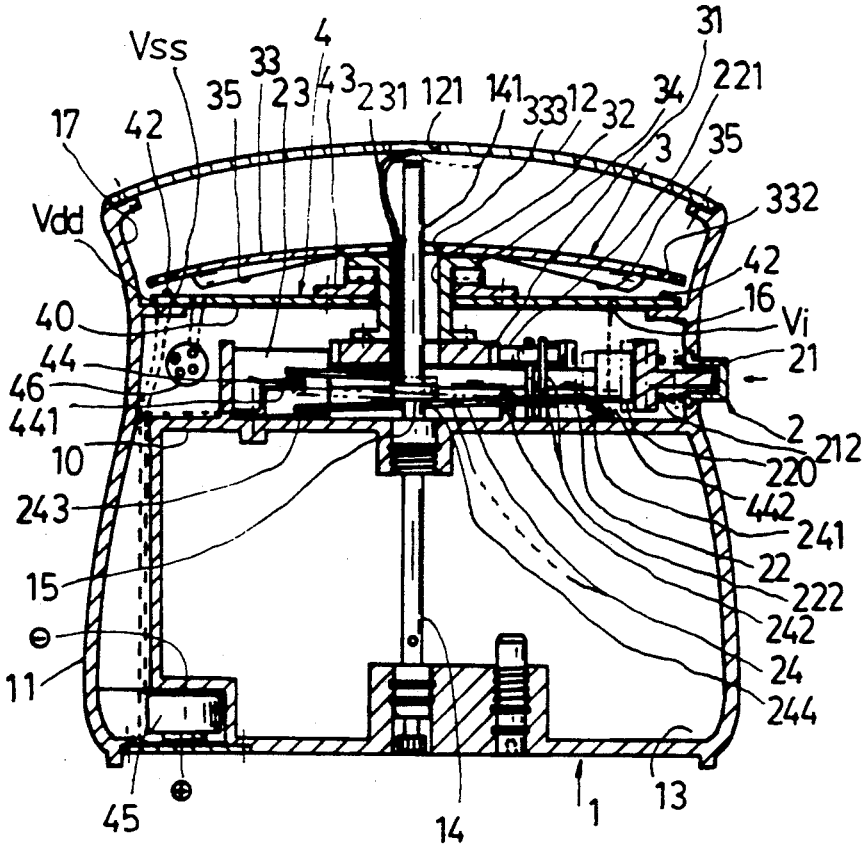
FIG. 3 is a sectional drawing of the present invention when viewed from 3—3 direction of FIG. 2.

The spring bar 221 is normally bent rearwardly from the actuating rod 22 as shown in FIG. 2 when the push button 21 is protruded outwardly from the casing 11 ready for depression. Upon an inward depression of the push button 21, the rod 22 will be depressed inwardly to bias the spring bar 221 outwardly about the limiting stoppers 222 as shown in dotted line as shown in FIG. 2 to slide away from the main ratchet teeth 311 of the driving gear 31. When releasing the inwardly-depressed push button 21, the rod 22 will be inwardly restored by a restoring spring 212 normally retaining the button 21 outwardly or a restoring spring 232 formed in the sparking generator 23 normally retaining the rod 22 outwardly to wipe the ratchet teeth 311 to quickly rotate the gear 31 and disk 33 counterclockwise as arrow direction (R) shown.

The decorative feature 331 annularly formed on the disk 33 may be selected from twelve symbols of astrology, such as: Aries, Taurus, Gemini, Cancer, Leo, Virgo, Libra, Scorpius, Sagittarius, Capricornus, Aquarius and Pisces; or may be selected from other figures or numbers, and are not limited in this invention. As shown in the figures, the features 331 are distributed in twelve sectors by dividing the circular disk 33.

The disk 33 may be made of transparent or translucent materials. If an optical transparency is not so good of the disk 33, a lamp hole 332 may be punched through the disk 33 for transmitting light from an indicator lamp 42 of the electronic driving means 4. A central holes 333 is formed in a central portion of the disk 33 for protruding the sparking terminal 231 and gas tube 14 therethrough. The gear 31 is also formed a central opening for passing the gas tube 14.

Figure 7:
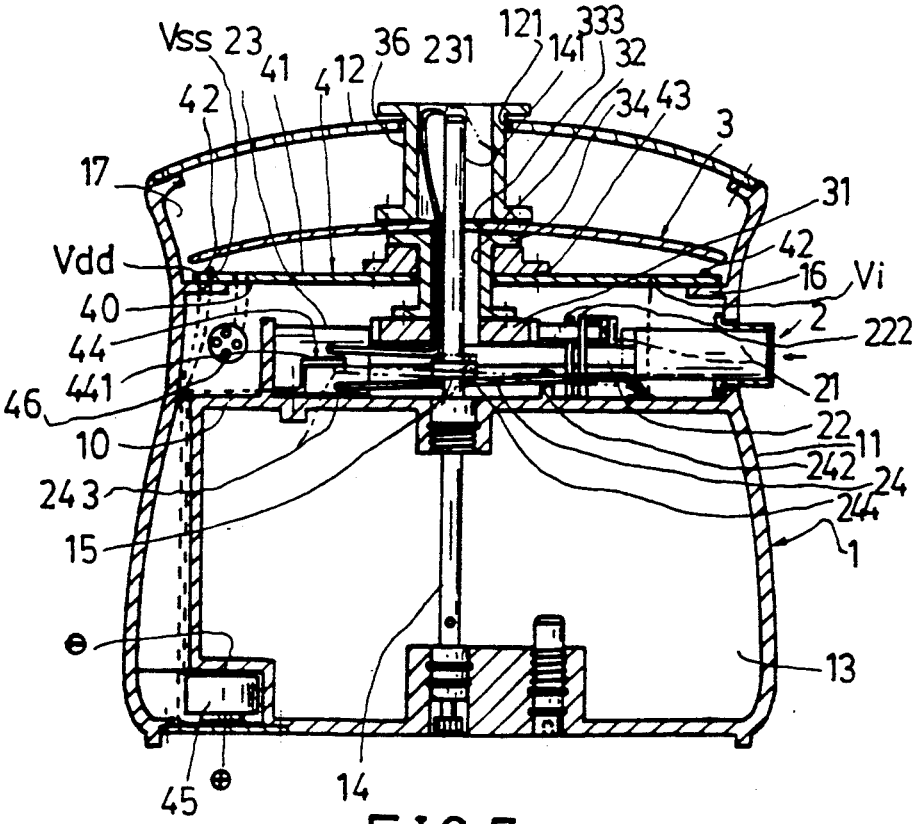
FIG. 7 is a sectional drawing of another preferred embodiment of the present invention.

The actuating rod 22 may be formed with a front head portion 220 to be slidably coupled with a triangle block 211 secured with the push button 21. Naturally, the push button 21 can be linearly secured with the rod 22 as shown in FIG. 7.

The trigger lever 24 includes: a front end portion 241 operatively depressed downwardly by the front head portion 220 of the actuating rod 22 when depressing the push button 21 for contacting a first contactor of a trigger switch 44 connected with an input pin VI of the electronic driving means 4, a pivot portion 242 formed on a central portion of the lever 24 which may be secured on the partition plate 10 serving as a fulcrum of the lever 24 when the front end portion 241 is depressed downwardly, a rearmost end portion 243 formed on a rearmost end of the lever 24 operatively biased upwardly to close a second contactor 441 of the trigger switch 44 electrically connecting a negative pole of a power source 45, and a rear end portion 243 adjacent to the rearmost end portion 244 for operatively opening the gas valve 15 when biased upwardly by depressing the front end portion 241 downwardly.

The electronic driving means 4 includes: a lotto flash driver 40, a base plate 41 for embedding a printed circuit board of the lotto flash driver 40 in the base plate 41 secured on an upper flange 16 formed in the upper chamber 17 of casing 11, a plurality of indicator lamps 42 which may be formed as light emitting diodes annularly distributed on a periphery of the base plate 21 each lamp 42 normally matched with and generally positioned under each decorative feature 331 of the disk 33, a sleeve 43 fixed on a central portion of the plate 21 for rotatably mounting the hollow shaft 32 therein, the trigger switch 44 operatively actuated for closing and driving a circuit of the lotto flash driver 40, the power source 45 which may be dry batteries storied in a bottom portion in the casing 11, and a buzzer 46 electrically connected to the driver 40.

The lotto flash driver 40 includes an integrated circuit (IC) having the plurality of indicator lamps (LED) 42 connected to a plurality of pins of the IC and having two poles of the power source 45 connected to the VSS and VDD pins of the IC. The trigger switch 44 will be closed by the trigger lever 24 which is made of electrically conductive materials operatively closing the two contactors 441, 442 to respectively connect the power source 45 and input pin VI of the IC of driver 40.

When depressing the push button 21 of the present invention, the actuating rod 22 is depressed inwardly to actuate the sparking generator 23 which is a conventional sparking or igniting means and to bias the trigger lever 24 to open the gas valve 15 for igniting a flame of the lighter means 1 for lighting cigarette, etc. The trigger switch 44 of the electronic driving means 4 is also closed to actuate the lotto flash driver 40 for flashing the lamps 42 and for sounding the buzzer 46 which produces sound comprised of a plurality of single short sound signals.

The spring bar 221 of the actuating rod 22 is biased and bent outwardly as shown in dotted line of FIG. 2 upon the depression of the push button 21. After releasing the button 21, the spring bar 221 will be recovered to wipe the ratchet teeth 311 formed on the driving gear 31 for rotating the gear 31, the shaft 32 and the disk 33 to rotate in a direction opposite to the flashing direction of the lamps 42 fixed on the base plate 41. The propeller impellers 35 formed under the disk 33 may aerodynamically float the disk 33 (when rotated) slightly upwardly to disengage the ratchet teeth 34 from the lower ratchet teeth 431 for a smooth operation of the disk 33.

The flashing illumination of lamps 42 will finally stop at any optional single lamp among the plural lamps 42 for a continuous illumination and the single sound signals will also be changed to be a music melody continuously played through the buzzer 46 for interesting bingo or lotto function. The continuously illuminating along with music sounding at a lamp is randomly operated which can be chosen from any commercial available integrated circuit. The flash driver 3 may be continuously flashing or sounding for a preset time duration even the switch 44 is switched off, and then stop after the preset time period is over.

After the rotating disk 33 is stopped, a number or feature 331 of the disk 33 will be lit by the illuminating lamp 42 positioned under the feature 331, thereby serving as an interesting lotto or bingo game.

Figure 6:
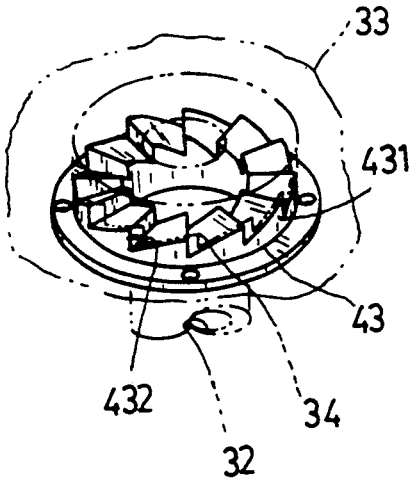
FIG. 6 is an illustration showing a positioning engagement of the rotating disk with the base plate in accordance with the present invention.

If the ratchet teeth 34 of the disk 33 are not sharply engaged with the ratchet teeth 431 of the sleeve 43 as shown in FIG. 6 after stopping the rotation of disk 33, the gravity of the disk 33 will then slide downwardly on the sloping surface 432 of ratchet tooth 431 until a final engagement between two teeth 34, 431, thereby helping a precise matching of a feature 331 with the illuminating lamp 42 for a bingo game.

The present invention may be further modified by those skilled in the art without departing from the spirit and scope of this invention.

Figure 8:
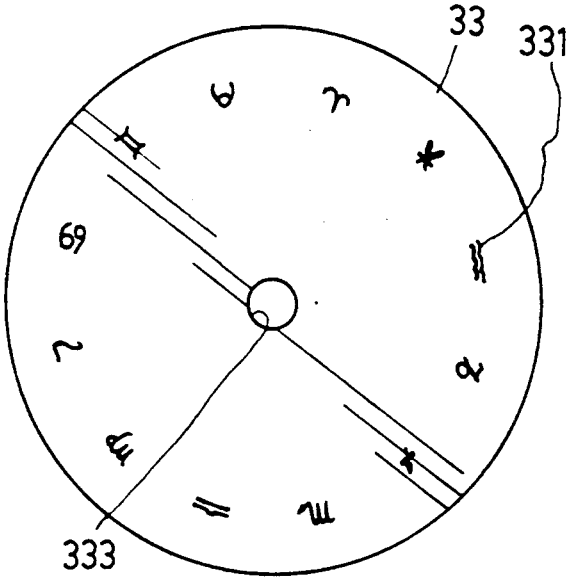
FIG. 8 is a top view of the rotating disk of the present invention as shown in FIG. 7.

Another preferred embodiment of the present invention is shown in FIGS. 7, 8, in which the ratchet teeth 34 under the disk 33 may be substituted with a bearing rotatably held in the sleeve 43. The propeller impeller 35 is also eliminated. By this modification, the structure of the lighter can be simplified. Of course, there may occur a phenomena when the lamp 42 is finally stopped and illuminating at a junction between two neighbouring features 331. The bingo game should then be repeatedly played to allow a final stopped illuminating lamp 42 matching with a feature 331 of the disk 33. In this modification, a flame stack 36 is provided on a central portion of the disk 33 within the central opening 121 of the top cover 12 for guiding flame upwardly of the lighter. The disk 33 may be made of transparent material for optical transmission purpose.

What is claimed is:

1. A gas lighter with rotational bingo means comprising:

a lighter means including a lighter casing having a gas container formed on a lower portion of the casing and an upper chamber formed on an upper portion of the casing above a middle partition plate, a top transparent cover formed on a top portion of the casing, and a gas tube having a sparking terminal formed at an upper portion of the gas tube and a gas valve for on-off control of a gas from the gas container;

an actuating means including a push button reciprocatively held in said lighter casing, an actuating rod coupled with said push button for operatively actuating a sparking generator for producing sparking at the sparking terminal for igniting a flame of the lighter, and a trigger lever operatively biased by said actuating rod and said push button for opening said gas valve; a rotating disk means including a driving gear operatively driven by said actuating rod of said actuating means, a hollow shaft secured with said driving gear rotatably mounted in a base plate secured in said upper chamber of said casing and a rotating disk secured on an upper portion of said shaft having a plurality of decorative features annularly formed on a periphery of said disk; and an electronic driving means including a lotto flash driver having an integrated circuit formed as a printed circuit board embedded in said base plate, a plurality of indicator lamps selected from light emitting diodes annularly distributed on a periphery of said rotating disk each said lamp normally matched with and positioned under each said decorative feature formed on said disk, a sleeve secured on said base plate for rotatably mounting said hollow shaft of said rotating disk, a trigger switch operatively actuated by said actuating rod and said push button for actuating said lotto flash driver, a buzzer electrically connected to said lotto flash driver for sounding purpose, and a power source for powering said lotto flash driver, whereby upon a depression of said push button to ignite a flame of said lighter, said trigger switch is closed to actuate said lotto flash driver for flashing said indicator lamps and for sounding said buzzer, and said rotating disk being operatively rotated by said actuating rod and finally stopped at a random position corresponding to a finally stopped illuminating lamp after a circular flashing operation around the plurality of said lamps upon the actuation of said lotto flash driver for interesting bingo or lotto game.

2. A gas lighter according to claim 1, wherein said actuating rod of said actuating means includes a spring bar protruding outwardly from said actuating rod retained by two limiting stoppers secured on said casing, said spring bar operatively wiping a plurality of main ratchet teeth circumferentially formed on said driving gear of said rotating disk means for rotating said driving gear and said rotating disk.

3. A gas lighter according to claim 1, wherein said trigger lever is pivotally mounted on said partition plate in said casing operatively biased by said actuating means to close a trigger switch electrically connected between a power source and an input pin of the integrated circuit of said lotto flash driver.

4. A gas lighter according to claim 1, wherein said rotating disk is formed with a plurality of upper ratchet teeth on a bottom surface of said disk engageable with a plurality of lower ratchet teeth formed on said sleeve secured on said base plate, and formed with a plurality of propeller impellers on a bottom surface of said disk facing said base plate.

5. A gas lighter according to claim 1, wherein said rotating disk, said hollow shaft, and said driving gear are each provided with a central opening or hole for upwardly protruding said gas tube therethrough, and said top cover is formed with a top central opening for guiding a flame ignited from the lighter upwardly.

* * * * *